US008186546B2

(12) United States Patent
Wang

(10) Patent No.: US 8,186,546 B2
(45) Date of Patent: May 29, 2012

(54) ADJUSTABLE DRESS FORM

(76) Inventor: Xiaoman Wang, Hangzhou (CN)

( * ) Notice: Subject to any disclaimer, the term of this patent is extended or adjusted under 35 U.S.C. 154(b) by 319 days.

(21) Appl. No.: 12/623,946

(22) Filed: Nov. 23, 2009

(65) Prior Publication Data

US 2011/0121040 A1 May 26, 2011

(51) Int. Cl.
*D06C 15/00* (2006.01)

(52) U.S. Cl. ..... 223/74; 223/71; 223/68

(58) Field of Classification Search ..... 223/66, 223/68–69, 74, 77, 80–81
See application file for complete search history.

(56) References Cited

U.S. PATENT DOCUMENTS

| | | | | | |
|---|---|---|---|---|---|
| 463,343 | A | * | 11/1891 | Perkins | 223/68 |
| 991,455 | A | * | 5/1911 | Hae | 223/68 |
| 1,107,331 | A | * | 8/1914 | Luery | 223/68 |
| 1,160,420 | A | * | 11/1915 | Levin | 223/68 |
| 1,221,522 | A | * | 4/1917 | Farquharson | 223/68 |
| 1,313,303 | A | * | 8/1919 | Konikoff | 223/68 |
| 1,514,086 | A | * | 11/1924 | Jack | 223/68 |
| 2,189,789 | A | * | 2/1940 | Frentzel | 223/70 |
| 2,646,907 | A | * | 7/1953 | Clawsey et al. | 223/68 |
| 3,734,362 | A | * | 5/1973 | Arthur | 223/68 |
| 3,838,800 | A | * | 10/1974 | Arthur et al. | 223/68 |
| 4,493,445 | A | * | 1/1985 | Arthur | 223/68 |
| 4,728,015 | A | * | 3/1988 | Holzapfel et al. | 223/70 |
| 5,265,779 | A | * | 11/1993 | Jiang | 223/68 |
| D467,619 | S | * | 12/2002 | Fullalove | D20/31 |

* cited by examiner

*Primary Examiner* — Shaun R Hurley
*Assistant Examiner* — Andrew Sutton
(74) *Attorney, Agent, or Firm* — Clement Cheng

(57) ABSTRACT

An adjustable dress form has a plurality of body panels and adjustment mechanisms securing between each of the body panels. There are a total of at least four body panels, and the adjustment mechanisms include preferably twelve adjustment mechanisms. A neck girth adjustment mechanism has four extension loops. The four extension loops are attached to an upper portion of each body panel. A turn button is mechanically connected to a plurality of gear teeth on four gear tooth arms that make up the four extension loops. The four gear tooth arms are attached to the upper portion of each at least four body panel. The four extension loops comprise the plurality of gear teeth on the four gear teeth arms. The gear teeth arms engage at about 90° angle to each other and are vertically staggered.

12 Claims, 5 Drawing Sheets

ADJUSTABLE DRESS FORM

FIELD OF THE INVENTION

The present invention is in the field of dress forms.

DISCUSSION OF RELATED ART

An adjustable body form or dress form has been invented previously by Arthur in U.S. Pat. No. 4,493,445, issued Jan. 15, 1985, the disclosure of which is incorporated herein by reference. Fullalove in United States design patent D467,619 issued Dec. 24, 2002 describes a multiple panel adjustable body form called a dress form. While there are a number of adjustable dress form apparatus in the marketplace, the present invention improves the mechanical functionality of the dress form.

SUMMARY OF THE INVENTION

The dress form has a supporting stand and can be the basis for a mannequin. The dress form has a plurality of panels that are connected together by adjustment mechanisms. The adjustment mechanisms lock to hold the panels in place. The dress form also has a telescopic supporting stand that can raise and lower for different height.

A user operates the adjustment mechanism of the dress form by rotating the adjustment locks. Preferably, a clockwise rotation increases the dimensions by moving the panels away from each other such that a gap between the panels increases at the neck. A counterclockwise rotation would then decrease the dimensions by moving the panels toward each other until the gap between the panels is eliminated. Preferably, the dress form has a total of thirteen adjustment locations. The neck adjustment is a single plate adjustment lock having a knob for increasing or decreasing the girth of the neck. The hip, waist and bust each have a front, left side, right side and back adjustment mechanism. The hip, waist and bust each have a total of four adjustment mechanisms for a total of twelve on the area below the neck. The adjustment mechanisms are shown as the wire adjusting lock.

A plurality of braces formed of strips of flexible metal attach between the supporting base and a panel of the dress form. The address one may have a total of four panels or eight panels. Each panel is flexible and bends relative to the other panels. The preferred method of construction is to have four panels, namely a right front body panel, a left front body panel, a left back body panel, and a right back body panel.

The plate adjustment lock has a knob that is connected to a knob gear. The knob gear rotates with the knob. The knob gear preferably rotates clockwise for expanding the neck and counterclockwise for contracting the girth of the neck. The knob gear is mechanically connected to the gear tooth of the upper short extension loop. The upper portion of the neck, and of the entire apparatus meets at the upper short extension loop, the lower long extension loop, the upper long extension loop, and the lower short extension loop. The four extension loops combined together form the upper portion of the neck and all are retractable and extendable away from the axis of the knob. The axis of the knob provides an origin for Cartesian quadrant segments of the device defining a front portion and a rear portion with a left portion and a right portion.

The knob gear engages with each of the extension loops on a side of the knob gear. The knob gear has a total of four sides that the gear tooth engages with. The gear teeth engage in a spiral pattern at ° from each other normal to the knob gear axis. The edges of the extension loop are fixed or bonded to the upper edges of the body panels. For providing a lack of interference between the gear teeth of different extension loops, the gear teeth have arms that are vertically staggered. The vertically staggered gear tooth arms present a gap between them.

The turn button is biased by pressure spring upward so that the elastic pin engages into the grooves shown on the base frame. The turn button is mounted on a button base which acts as a base frame. The grooves have protrusions between them formed on the outside housing of the row gear rack. The pressure spring retains the elastic pin against the grooves on the base frame to provide discrete neck width settings.

The plate adjusting lock includes a turn button, a button base and a base frame. The turn button has a turn handle with a belt shaft pin. The middle section of the shaft pin is engaged with a gear rack. The tip is engaged with an elastic pin hole which is installed with an elastic pin inside. The middle of the button base is engaged with a concave circular groove that contains the turn handle of the turn button and the pressure spring installed between the turn handle of the turn button in the concave circular groove. Also, there is a gap that is larger than the diameter of the elastic pin between the turn handle underside of the turn button and the circular groove underside. The rack tooth of the middle shaft pin of turn button is engaged with four extension moves which are limited along the axial direction of the turn button relative to the base frame. The gear gap of the row gear racks is larger than the diameter of the elastic pin. A pin cushion next to the turn button provides ready pin storage.

The lock hole of the adjustment mechanism is preferably triangular for receiving a triangular key. The one gear basin has a plurality of gear teeth engaging with a lower gear push rod. The lower gear push rod is connected to a first panel. The one gear basin also has connection to an upper gear push rod which has connection to a second panel. When the gear basin is rotated it contracts or expands the body panel toward or away from each other for adjusting the dimensions of the dress form. The gear rack of the gear basin thus has a central gear with an upper pinion and a lower pinion, whereby the upper pinion is secured to a first panel and the lower pinion is secured to a second panel.

A spring biases between the staff gauge and the gear basin base. The two ends of the staff gauge are positioned within the runner of the upper gear push rod and the lower gear push rod that are secured by a plurality of nut holes. A plurality of nut holes therefore provides securing between the body panel and adjustment mechanism. An adjustable lever rotated by the operation of a triangular key in the lock hole protrudes through the staff gauge.

A stand has a plurality of supports that are formed as a frame. The stand frame has a pair of generally horizontal members and a pair of generally vertical members. The stand frame can be made foldable. The stand frame attaches to a vertical post portion of the stand. The vertical post portion of the stand supports the adjustable dress form. The stand portion that rests on the ground has four contacts with the floor. The four contacts are preferably approximately 90° from each other. The stand portion preferably is configured so that it can be removed from the form and interchanged with another form.

The following drawings use the call out list of elements below.

1 Plate Adjusting Lock
2 Right Front Body Panel
3 Wire Adjusting Lock
4 Supporting Stand
5 Left Front Body Panel
6 Central Lever
7 Left Back Body Model
8 Side Adjusting Locks
9 Base
10 Braces
11 Turn Button
12 Pressure Spring
13 Button Base
14 Upper Short Extension Loop
15 Base Frame
16 Elastic Pin
17 Lower Long Extension Loop
18 Upper Long Extension Loop
19 Lower Short Extension Loop
31 Adjustable Lever
32 Staff Gauge
33 Upper Gear Push Rod
34 Gear Basin Base
35 One Gear Basin
36 Lower Gear Push Rod
131 Pincushion
142 Gear Tooth
151 Row Gear Racks
311 Lock Hole
361 Nut Hole

DETAILED DESCRIPTION OF THE PREFERRED EMBODIMENT

Figure 1:
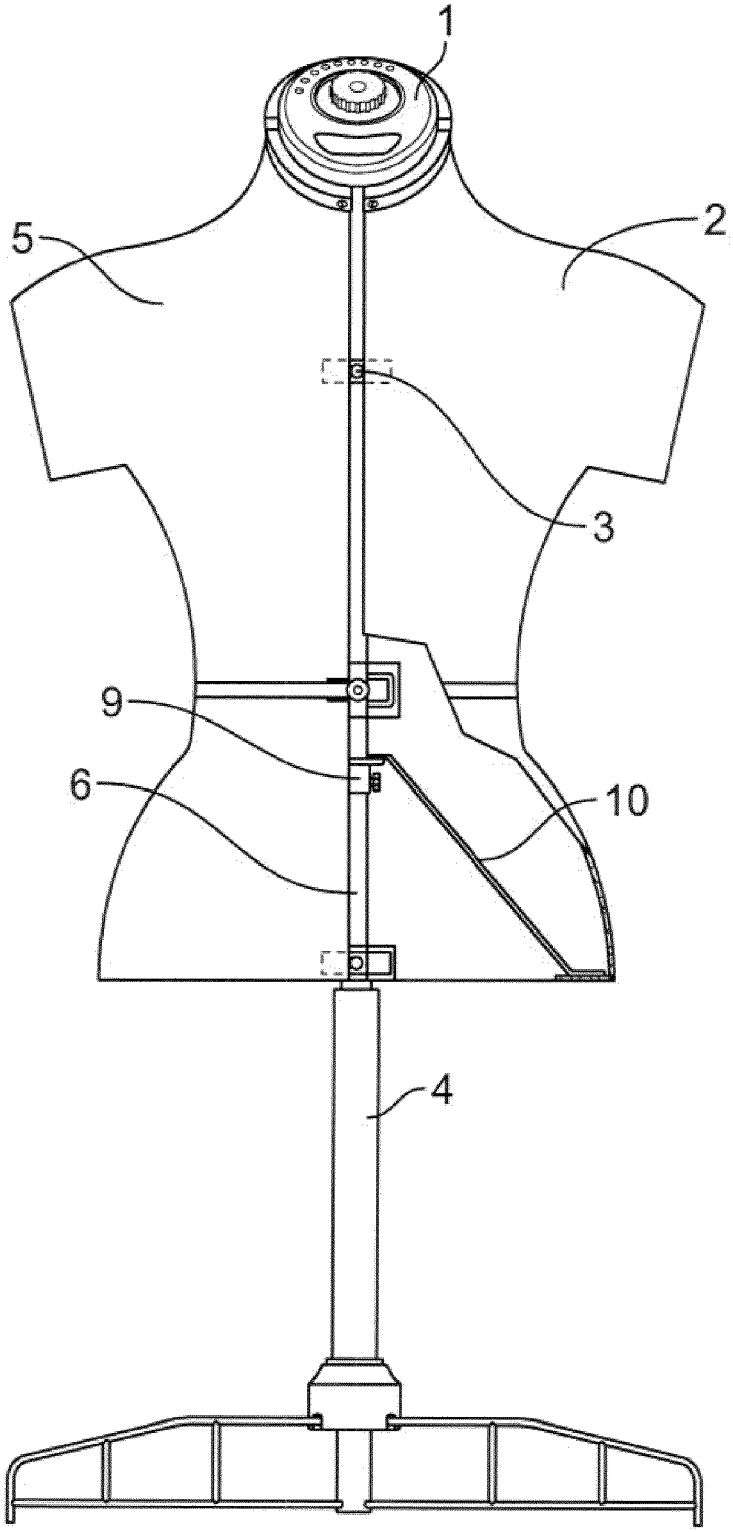
FIG. 1 is a front view of the adjustable dress form.
Figure 2:
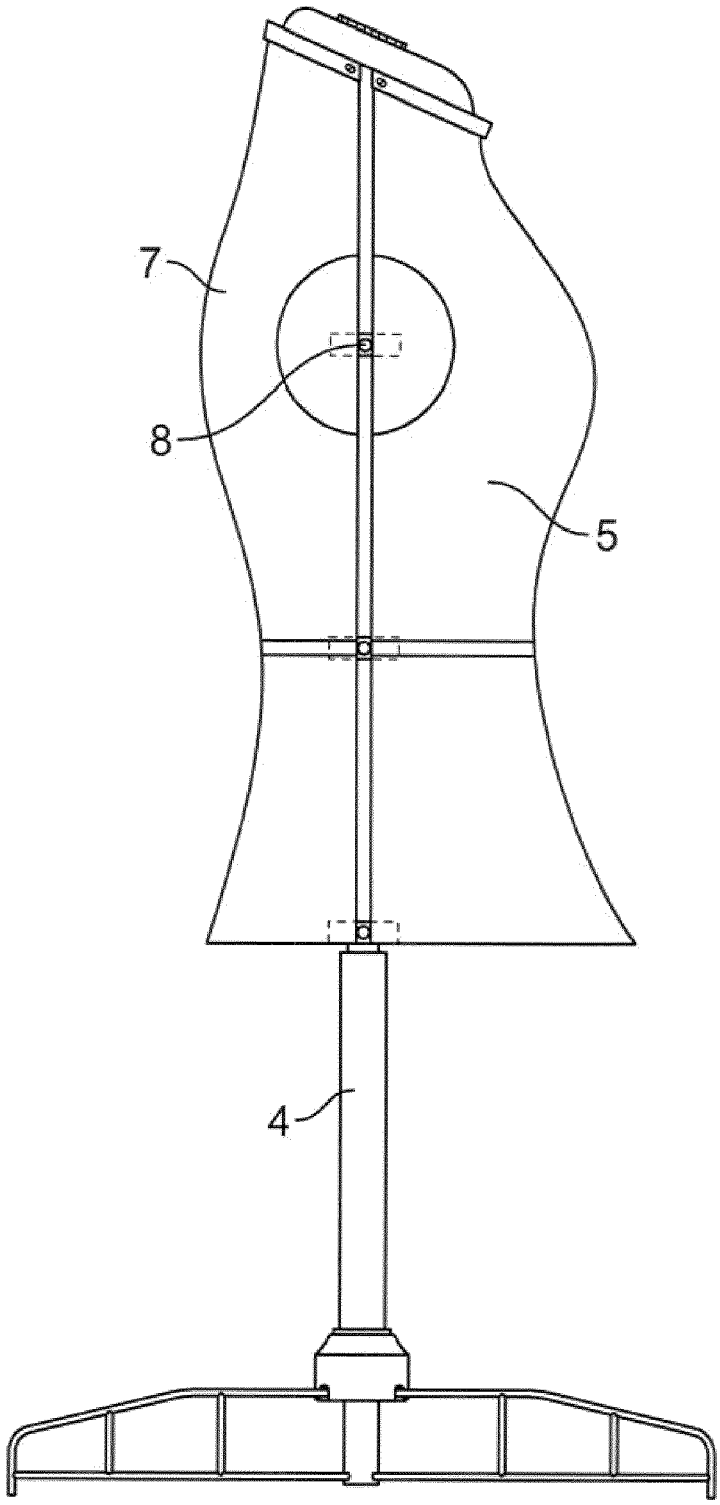
FIG. 2 is a side view of the adjustable dress form.
Figure 3:
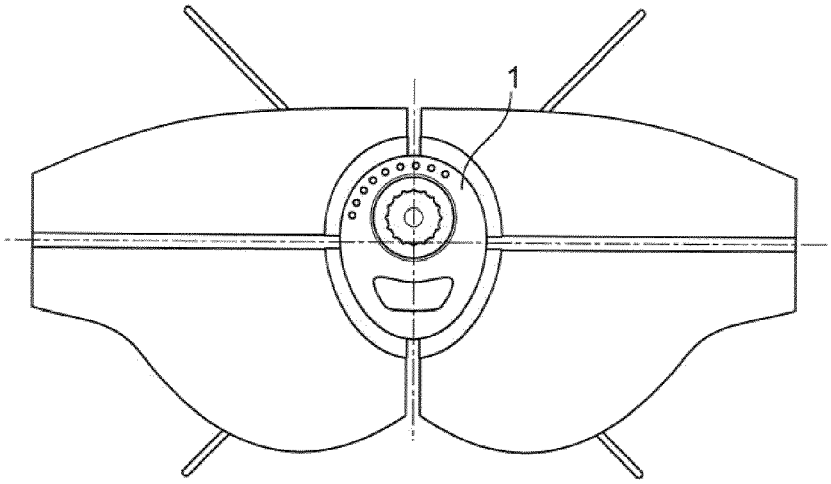
FIG. 3 is a top view of the adjustable dress form.
Figure 4:
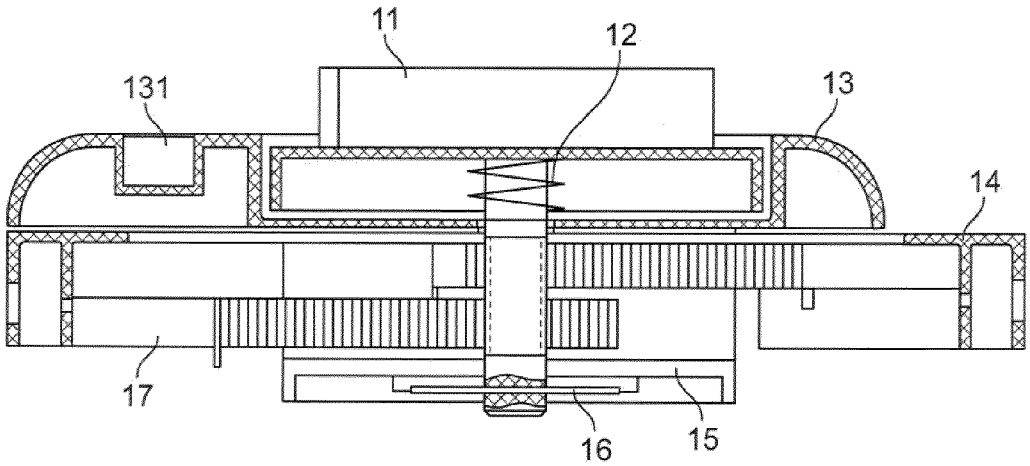
FIG. 4 is a cross-section view of the adjustment mechanism of the adjustable dress form.
Figure 5:
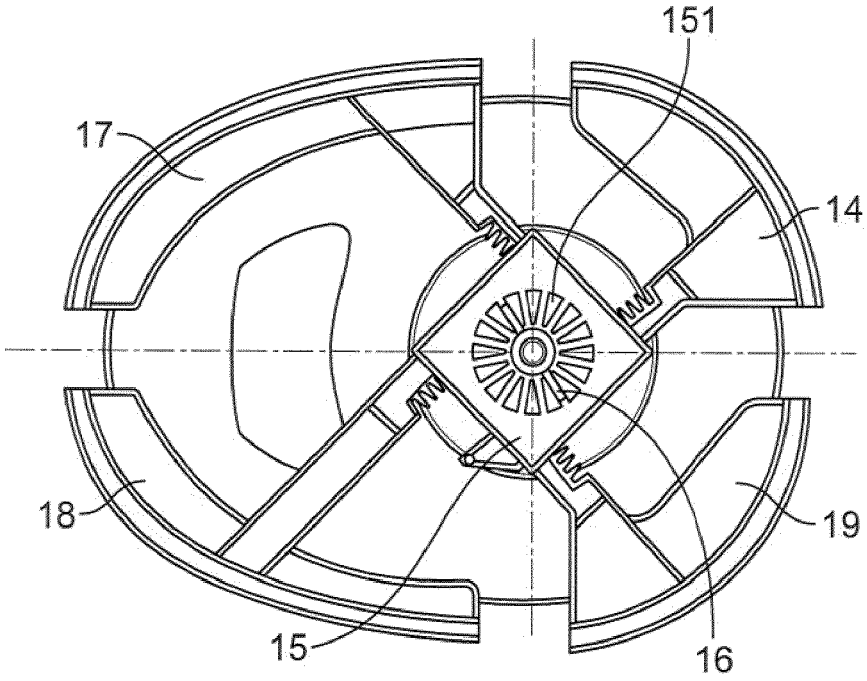
FIG. 5 is a top view of the adjustment mechanism.
Figure 6:
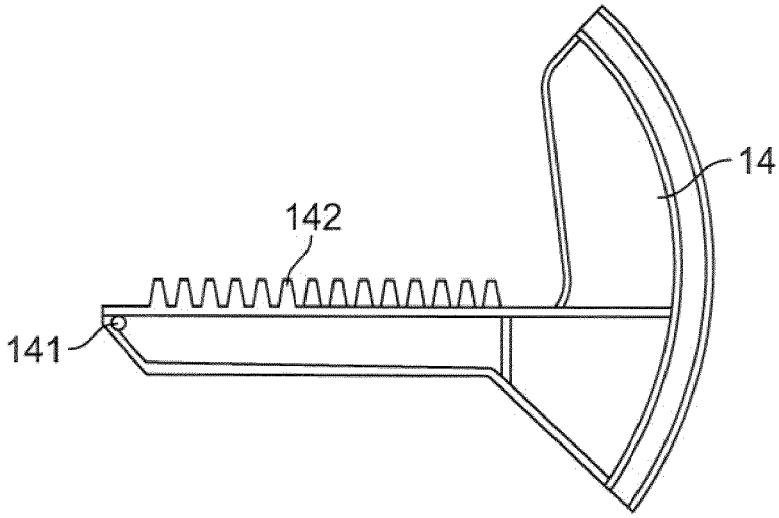
FIG. 6 is a single segment of the adjustment mechanism.
Figure 7:
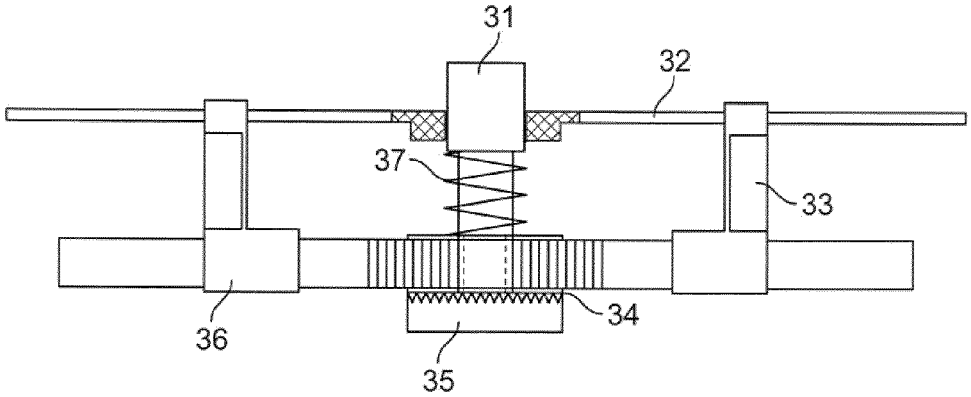
FIG. 7 is a side view of the adjustment mechanism.
Figure 8:
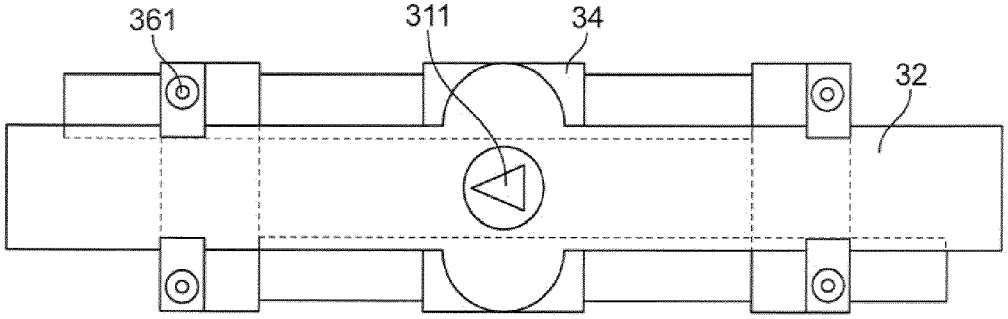
FIG. 8 is a side view of the adjusting mechanism showing the lock hole.

As seen in FIGS. 1-8, the dress form has a supporting stand 4 and can be the basis for a mannequin. The dress form has a plurality of panels that are connected together by adjustment mechanisms. The adjustment mechanisms lock to hold the panels in place. The dress form also has a telescopic supporting stand 4 that can raise and lower for different height.

A user operates the adjustment mechanism of the dress form by rotating the adjustment locks. Preferably, a clockwise rotation increases the dimensions by moving the panels away from each other such that a gap between the panels increases. A counterclockwise rotation would then decrease the dimensions by moving the panels toward each other until the gap between the panels is eliminated. Preferably, the dress form has a total of thirteen adjustment locations. The neck adjustment is a single plate adjustment lock 1 having a knob for increasing or decreasing the girth of the neck. The hip, waist and bust each have a front, left side, right side and back adjustment mechanism. The hip, waist and bust each have a total of four adjustment mechanisms for a total of twelve on the area below the neck. The adjustment mechanisms are shown as the wire adjusting lock 3.

A plurality of braces 10 formed of strips of flexible metal attach between the supporting base 9 and a panel of the dress form. The address one may have a total of four panels or eight panels. Each panel is flexible and bends relative to the other panels. The preferred method of construction is to have four panels, namely a right front body panel 2, a left front body panel 5, a left back body panel 7, and a right back body panel.

The plate adjustment lock 1 has a knob that is connected to a knob gear. The knob gear rotates with the knob. The knob gear preferably rotates clockwise for expanding the neck and counterclockwise for contracting the girth of the neck. The knob gear is mechanically connected to the gear tooth 142 of the upper short extension loop 14. The upper portion of the neck, and of the entire apparatus is at the upper short extension loop 14, the lower long extension loop 17, the upper long extension loop 18, and the lower short extension loop 19. The four extension loops combined together form the upper portion of the neck and all are retractable and extendable away from the axis of the knob. The dashed lines in FIG. 5 locate in cross hairs the axis of the knob and define Cartesian quadrants of the device.

The knob gear engages with each of the extension loops on a side of the knob gear. The knob gear has a total of four sides that the gear tooth 142 engages with. The gear teeth engage in a spiral pattern at about 90° from each other normal to the knob gear axis. The edges of the extension loop are fixed or bonded to the upper edges of the body panels. For providing a lack of interference between the gear teeth of different extension loops, the gear teeth have arms that are vertically staggered. The vertically staggered gear tooth arms present a gap between them.

The turn button 11 is biased by pressure spring 12 upward so that the elastic pin 16 engages into the grooves shown on the base frame 15. The turn button is mounted on a button base 13 which acts as a base frame. The grooves have protrusions between them formed on the outside housing of the row gear rack 151. The pressure spring retains the elastic pin against the grooves on the base frame to provide discrete neck width settings.

The plate adjusting lock 1 includes a turn button 11, a button base 13 and a base frame 15. The turn button 11 has a turn handle with a belt shaft pin. The middle section of the shaft pin is engaged with a gear rack. The tip is engage with an elastic pin hole which is installed with an elastic pin inside. The middle of the button base 13 is engaged with a concave circular groove that contains the turn handle of the turn button 11 and the pressure spring 12 installed between the turn handle of the turn button 11 in the concave circular groove. Also, there is a gap that is larger than the diameter of the elastic pin 16 between the turn handle underside of the turn button 11 and the circular groove underside. The rack tooth of the middle shaft pin of turn button 11 is engaged with four extension moves which are limited along the axial direction of the turn button 11 relative to the base frame 15. The gear gap of the row gear racks 151 is larger than the diameter of the elastic pin 16. A pin cushion 131 next to the turn button provides ready pin storage.

The lock hole 311 of the adjustment mechanism is preferably triangular for receiving a triangular key. The one gear basin 35 has a plurality of gear teeth engaging with a lower gear push rod 36. The lower gear push rod is connected to a first panel. The one gear basin 35 also has connection to an upper gear push rod 33 which has connection to a second panel. When the gear basin is rotated it contracts or expands the body panel toward or away from each other for adjusting the dimensions of the dress form. The gear rack of the gear basin thus has a central gear with an upper pinion and a lower pinion, whereby the upper pinion is secured to a first panel and the lower pinion is secured to a second panel.

A spring 37 biases between the staff gauge 32 and the gear basin base 34. The two ends of the staff gauge are positioned within the runner of the upper gear push rod 33 and the lower gear push rod that are secured by a plurality of nut holes 361. A plurality of nut holes 361 therefore provide securing between the body panel and adjustment mechanism. An adjustable lever rotated by the operation of a triangular key in the lock hole 311 protrudes through the staff gauge 32.

A stand 4 has a plurality of supports that are formed as a frame. The stand frame has a pair of generally horizontal members and a pair of generally vertical members. The stand frame can be made foldable. The stand frame attaches to a vertical post portion of the stand. The vertical post portion of the stand supports the adjustable dress form.

Not all of the adjustment mechanisms need to be used, less than all of the adjustment in mechanisms can be used, such as by providing only five or ten in strategically located more commonly used locations.

The invention claimed is:

1. An adjustable dress form comprising:

a. a plurality of body panels;

b. a plurality of adjustment mechanisms securing between each of the plurality of body panels, wherein there are a total of at least four body panels, wherein the plurality of adjustment mechanisms include at least five adjustment mechanisms;

c. a neck girth adjustment mechanism comprising four extension loops, wherein the four extension loops are attached to an upper portion of each at least four body panel; and further comprising a turn button mechanically connected to a plurality of gear tooth on four gear tooth arms that make up the four extension loops, wherein the four gear tooth arms are attached to the upper portion of each at least four body panel, wherein the four extension loops comprised the plurality of gear tooth on four gear tooth arms;

d. wherein the turn button is biased away from a button base by a spring, wherein an elastic pin selectively engages into a plurality of radially extending grooves, wherein turn button rotation causes axial expansion of a neck portion of the dress form by axial expansion of the four extension loops.

2. The adjustable dress form of claim 1, wherein the four extension loops comprise an upper short extension loop, an upper long extension loop, a lower short extension loop, and a lower long extension loop.

3. The adjustable dress form of claim 2, wherein each of the plurality of adjustment mechanisms further comprises a lock hole driving a adjustable lever, wherein the adjustable lever is mechanically connected to a gear, wherein the gear is mechanically connected to an upper pinion and a lower pinion, wherein the upper pinion is connected to a first body panel and the lower pinion is connected to a second body panel.

4. The adjustable dress form of claim 1, wherein the four extension loops comprise an upper short extension loop, an upper long extension loop, a lower short extension loop, and a lower long extension loop, wherein each of the plurality of adjustment mechanisms further comprises a lock hole driving a adjustable lever, wherein the adjustable lever is mechanically connected to a gear, wherein the gear is mechanically connected to an upper pinion and a lower pinion, wherein the upper pinion is connected to a first body panel and the lower pinion is connected to a second body panel.

5. An adjustable dress form comprising:

a. a plurality of body panels:

b. a plurality of adjustment mechanisms securing between each of the plurality of body panels, wherein there are a total of at least four body panels, wherein the plurality of adjustment mechanisms include at least five adjustment mechanisms;

c. a neck girth adjustment mechanism comprising four extension loops, wherein the four extension loops are attached to an upper portion of each at least four body panel;

d. a turn button mechanically connected to a plurality of gear tooth on four gear tooth arms that make up the four extension loops, wherein the four gear tooth arms are attached to the upper portion of each at least four body panel, wherein the four extension loops comprised the plurality of gear tooth on four gear tooth arms, wherein the gear tooth arms engage at about 90° angle to each other, wherein the gear tooth arms are vertically staggered, e. wherein the turn button is biased away from a button base by a spring, wherein an elastic pin selectively engages into a plurality of radially extending grooves, wherein turn button rotation causes axial expansion of a neck portion of the dress form by axial expansion of the four extension loops.

6. The adjustable dress form of claim 5, wherein the four extension loops comprise an upper short extension loop, an upper long extension loop, a lower short extension loop, and a lower long extension loop.

7. The adjustable dress form of claim 6, wherein each of the plurality of adjustment mechanisms further comprises a lock hole driving a adjustable lever, wherein the adjustable lever is mechanically connected to a gear, wherein the gear is mechanically connected to an upper pinion and a lower pinion, wherein the upper pinion is connected to a first body panel and the lower pinion is connected to a second body panel.

8. An adjustable dress form comprising:

a. a plurality of body panels;

b. a plurality of adjustment mechanisms securing between each of the plurality of body panels, wherein there are a total of at least four body panels, wherein the plurality of adjustment mechanisms include at least five adjustment mechanisms;

c. a neck girth adjustment mechanism comprising four extension loops, wherein the four extension loops are attached to an upper portion of each at least four body panel;

d. a turn button mechanically connected to a plurality of gear tooth on four gear tooth arms that make up the four extension loops, wherein the four gear tooth arms are attached to the upper portion of each at least four body panel, wherein the four extension loops comprised the plurality of gear tooth on four gear tooth arms, wherein the gear tooth arms engage at about 90° angle to each other, wherein the gear tooth arms are vertically staggered, wherein the four extension loops comprise an upper short extension loop, an upper long extension loop, a lower short extension loop, and a lower long extension loop.

9. The adjustable dress form of claim 8, wherein each of the plurality of adjustment mechanisms further comprises a lock hole driving a adjustable lever, wherein the adjustable lever is mechanically connected to a gear, wherein the gear is mechanically connected to an upper pinion and a lower pinion, wherein the upper pinion is connected to a first body panel and the lower pinion is connected to a second body panel.

10. An adjustable dress form comprising:

a. a plurality of body panels;

b. a plurality of adjustment mechanisms securing between each of the plurality of body panels, wherein there are a total of at least four body panels, wherein the plurality of adjustment mechanisms include at least ten adjustment mechanisms;

c. a neck girth adjustment mechanism comprising four extension loops, wherein the four extension loops are attached to an upper portion of each at least four body panel;

d. a turn button mechanically connected to a plurality of gear tooth on four gear tooth arms that make up the four extension loops, wherein the four gear tooth arms are attached to the upper portion of each at least four body panel, wherein the four extension loops comprised the plurality of gear tooth on four gear tooth arms, wherein the gear tooth arms engage at about 90° angle to each other, wherein the gear tooth arms are vertically staggered;

e. wherein the turn button is biased away from a button base by a spring, wherein an elastic pin selectively engages into a plurality of radially extending grooves, wherein turn button rotation causes axial expansion of a neck portion of the dress form by axial expansion of the four extension loops.

11. The adjustable dress form of claim 10, wherein the four extension loops comprise an upper short extension loop, an upper long extension loop, a lower short extension loop, and a lower long extension loop.

12. The adjustable dress form of claim 11, wherein each of the plurality of adjustment mechanisms further comprises a lock hole driving a adjustable lever, wherein the adjustable lever is mechanically connected to a gear, wherein the gear is mechanically connected to an upper pinion and a lower pinion, wherein the upper pinion is connected to a first body panel and the lower pinion is connected to a second body panel.

* * * * *